US012195819B2

(12) United States Patent
Takashima et al.

(10) Patent No.: US 12,195,819 B2
(45) Date of Patent: Jan. 14, 2025

(54) HIGH-STRENGTH THIN STEEL SHEET AND METHOD FOR MANUFACTURING SAME

(71) Applicant: JFE STEEL CORPORATION, Tokyo (JP)

(72) Inventors: Katsutoshi Takashima, Tokyo (JP); Takeshi Yokota, Tokyo (JP)

(73) Assignee: JFE STEEL CORPORATION, Chiyoda-ku (JP)

( * ) Notice: Subject to any disclaimer, the term of this patent is extended or adjusted under 35 U.S.C. 154(b) by 500 days.

(21) Appl. No.: 17/632,566

(22) PCT Filed: Jul. 16, 2020

(86) PCT No.: PCT/JP2020/027730

§ 371 (c)(1),
(2) Date: Feb. 3, 2022

(87) PCT Pub. No.: WO2021/024748

PCT Pub. Date: Feb. 11, 2021

(65) Prior Publication Data

US 2022/0275471 A1 Sep. 1, 2022

(30) Foreign Application Priority Data

Aug. 6, 2019 (JP) ..... 2019-144678

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/28*** | (2006.01) |
| ***C23G 1/08*** | (2006.01) |

(52) U.S. Cl.

CPC ..... *C21D 9/46* (2013.01); *C21D 8/0226* (2013.01); *C21D 8/0236* (2013.01); *C21D 8/0263* (2013.01); *C21D 8/0268* (2013.01); *C22C 38/001* (2013.01); *C22C 38/002* (2013.01); *C22C 38/02* (2013.01); *C22C 38/04* (2013.01); *C22C 38/06* (2013.01); *C23C 2/0224* (2022.08); *C23C 2/024* (2022.08); *C23C 2/28* (2013.01); *C23G 1/081* (2013.01); *C21D 2211/002* (2013.01); *C21D 2211/005* (2013.01); *C21D 2211/008* (2013.01)

(58) Field of Classification Search

CPC ..... C21D 9/46; C21D 8/0226; C21D 8/0236; C21D 8/0263; C21D 8/0268; C21D 2211/002; C21D 2211/005; C21D 2211/008; C21D 1/18; C21D 1/25; C21D 6/002; C21D 6/005; C21D 6/008; C21D 8/0205; C21D 8/0273; C21D 8/0278; C21D 8/0405; C21D 8/0426; C21D 8/0436; C21D 8/0463; C21D 8/0473; C21D 2211/001; C21D 8/0247; C22C 38/001; C22C 38/002; C22C 38/02; C22C 38/04; C22C 38/06; C22C 38/08; C22C 38/26; C22C 38/28; C22C 38/005; C22C 38/14; C22C 38/12; C22C 38/16; C22C 38/38; C22C 38/58; C22C 38/60; C22C 38/008; C22C 38/10; C22C 38/105; C22C 38/20; C22C 38/22; C22C 38/24; C22C 38/30; C22C 38/32; C22C 38/42; C22C 38/44; C22C 38/46; C22C 38/48; C22C 38/50; C22C 38/52; C22C 38/54; C23C 2/0224; C23C 2/024; C23C 2/28; C23C 2/06; C23C 2/12; C23C 2/40; C23G 1/081

See application file for complete search history.

(56) References Cited

U.S. PATENT DOCUMENTS

| | | | | |
|---|---|---|---|---|
| 8,343,288 | B2 | 1/2013 | Murakami et al. | |
| 11,193,180 | B2 | 12/2021 | Takashima et al. | |
| 2003/0041933 | A1* | 3/2003 | Cornet | C21D 1/19 148/664 |
| 2011/0030854 | A1 | 2/2011 | Matsuda et al. | |
| 2012/0009434 | A1 | 1/2012 | Hata et al. | |
| 2017/0183752 | A1* | 6/2017 | Fukuda | C22C 38/004 |
| 2019/0003009 | A1* | 1/2019 | Kawata | C22C 38/04 |
| 2019/0078173 | A1* | 3/2019 | Takashima | C22C 38/50 |
| 2019/0330721 | A1 | 10/2019 | Hayashi et al. | |
| 2021/0381076 | A1 | 12/2021 | Kohsaka et al. | |

FOREIGN PATENT DOCUMENTS

| | | |
|---|---|---|
| EP | 2589674 A1 | 5/2013 |
| EP | 3444372 A1 | 2/2019 |

(Continued)

OTHER PUBLICATIONS

Machine Translation of WO-2017203994-A1 (Year: 2017).*

(Continued)

*Primary Examiner* — Adil A. Siddiqui
(74) *Attorney, Agent, or Firm* — KENJA IP LAW PC

(57) ABSTRACT

The high-strength thin steel sheet has a chemical composition containing C, Si, Mn, P, S, Al, and N, with the balance being Fe and inevitable impurities, and a complex structure containing ferrite, tempered martensite, and bainite, where a volume fraction of a total of tempered martensite and bainite containing five or more carbides with a particle size of 0.1 μm or more and 1.0 μm or less in a grain with respect to a total of the tempered martensite and the bainite is 85% or more, and C mass % and Mn mass % in a region of 20 μm or less in a thickness direction from a surface of the steel sheet are each 20% or less with respect to C mass % and Mn mass % in a region of 100 μm or more and 200 μm or less from the surface of the steel sheet.

4 Claims, No Drawings

(56) References Cited

FOREIGN PATENT DOCUMENTS

| | | | | | |
|---|---|---|---|---|---|
| EP | 3476963 | A1 | | 5/2019 | |
| JP | 2009203550 | A | | 9/2009 | |
| JP | 2009215571 | A | | 9/2009 | |
| JP | 2012157900 | A | | 8/2012 | |
| JP | 6032173 | B2 | | 11/2016 | |
| WO | 2017179372 | A1 | | 10/2017 | |
| WO | WO-2017203994 | A1 | * | 11/2017 | ..... C21D 8/0226 |
| WO | 2018055695 | A1 | | 3/2018 | |
| WO | 2020080337 | A1 | | 4/2020 | |

OTHER PUBLICATIONS

Aug. 2, 2022, the Extended European Search Report issued by the European Patent Office in the corresponding European Patent Application No. 20850681.6.

Oct. 6, 2020, International Search Report issued in the International Patent Application No. PCT/JP2020/027730.

* cited by examiner

HIGH-STRENGTH THIN STEEL SHEET AND METHOD FOR MANUFACTURING SAME

TECHNICAL FIELD

This disclosure relates to a high-strength thin steel sheet and a method for manufacturing the same, and particularly relates to a high-strength thin steel sheet suitable as members of structural components of automobiles or the like and a method for manufacturing the same.

BACKGROUND

In recent years, $CO_2$ emission regulations have become more stringent due to rising environmental problems, and in the automobile field, weight reduction of vehicle bodies has become an issue for reduced fuel consumption. Therefore, the thickness of structural parts is being reduced by applying high-strength steel sheets to automotive parts, and particularly by applying high-strength thin steel sheets with a tensile strength (TS) of 1180 MPa or more.

High-strength steel sheets used for structural parts and reinforcing parts of automobiles are required to have excellent workability. Particularly in a case of forming parts with complex shapes, high-strength steel sheets that are excellent in all properties such as elongation and hole expansion formability, rather than those excellent in only individual properties, are required.

Further, there is a concern that high-strength steel sheets with a TS of 1180 MPa or more may suffer delayed fracture (hydrogen embrittlement) due to hydrogen that has entered from an operating environment. Therefore, high-strength thin steel sheets to be applied to the automobile field are required to have high formability as well as excellent delayed fracture resistance.

Furthermore, an automotive body of an automobile is mostly assembled by resistance spot welding, where some parts in which a welding gun of a resistance spot welding machine cannot penetrate are assembled by bolt welding. Bolt welding is also often used when assembling different materials. When the bolt welding is used, a nut having a projection portion is first welded to a steel sheet through projection welding, and then a bolt is passed through the nut to assemble materials. In automobiles manufactured using the bolt welding, stress is also applied to a projection weld to maintain the rigidity of the entire automotive body. Therefore, the properties of a projection weld are also important.

Examples of conventional methods of improving the workability of a steel sheet and the delayed fracture resistance of a base steel sheet include a method of controlling the shapes of martensite and bainite, as described in JP 6032173 B (PTL 1). Further, examples of methods of improving the peeling strength in a projection weld include a technique of controlling welding condition to improve the peeling strength, as described in JP 2012-157900 A (PTL 2).

CITATION LIST

Patent Literature

PTL 1: JP 6032173 B
PTL 2: JP 2012-157900 A

SUMMARY

Technical Problem

We recognize a novel problem of improving not only the delayed fracture resistance of a base steel sheet but also the delayed fracture resistance of a projection weld. A high-strength thin steel sheet that comprehensively satisfies all of the properties of workability, delayed fracture resistance of a base steel sheet, and delayed fracture resistance of a projection weld has not been developed.

It could thus be helpful to provide a high-strength thin steel sheet with a tensile strength of 1180 MPa or more that has excellent workability, delayed fracture resistance of a base steel sheet and delayed fracture resistance of a projection weld, as well as a method for manufacturing the same.

In the present disclosure, the term "thin steel sheet" means a steel sheet having a thickness of 0.6 mm or more and 2.8 mm or less.

Further, "excellent workability" means that the material has both excellent elongation and excellent hole expansion formability. "Excellent elongation" means that the elongation (EL) is 14% or more. "Excellent hole expansion formability" means that the hole expansion ratio ($\lambda$) is 50% or more.

"Excellent delayed fracture resistance of a base steel sheet" means that no cracking occurs even when the entire steel sheet is subjected to a constant load test and electrolytically charged for 100 hours.

Further, "excellent delayed fracture resistance of a projection weld" means that no cracking occurs even when the projection weld is subjected to a constant load test and electrolytically charged for 100 hours. In the following description, the delayed fracture resistance of a base steel sheet and the delayed fracture resistance of a projection weld may be collectively and simply referred to as "delayed fracture resistance".

Solution to Problem

As a result of intensive studies, we found that it is possible to obtain a high-strength thin steel sheet that comprehensively satisfies all of the properties of workability, delayed fracture resistance of a base steel sheet, and delayed fracture resistance of a projection weld by controlling the volume fractions of ferrite, tempered martensite, and bainite in the steel sheet to specific ratios, refining the average grain size of each steel sheet microstructure, softening hard martensite that may deteriorate workability and delayed fracture properties, and reducing the concentrations of C and Mn in a surface layer of the steel sheet. That is, we found the following.

(1) When the hardness difference between soft ferrite and hard martensite is large during punching in a hole expanding test, voids are formed at the interface, and an increased number of voids deteriorates the hole expansion formability. On the other hand, we found that the hardness difference between ferrite and tempered martensite can be reduced by tempering and softening martensite, which reduces the formation of voids and improves the workability of a steel sheet.

(2) Hydrogen penetration into steel causes formation and propagation of cracks in the steel, resulting in so-called delayed fracture. As a result of intensive studies, we found that hard martensite is a region where cracks occur in steel with a complex structure. We found that the formation of cracks can be reduced by tempering the martensite.

(3) Further, we found that, when the alloy content in steel is increased to ensure the strength, the resistance during projection welding is increased, and microvoids are formed at a welding interface. We also found that cracks propagate from the microvoids when a stress is applied or hydrogen penetrates into the steel with microvoids. As a result of intensive studies, we found that, by appropriately specifying the dew point in a temperature range of 600° C. or higher during annealing and the C and Mn contents in the steel, and by reducing the concentrations of C and Mn in a surface layer of the steel sheet, the initial current efficiency during projection welding can be increased and the aforementioned microvoids can be eliminated. We found that the delayed fracture resistance of a projection weld can be improved in this way.

(4) Furthermore, we found that, by using carbides in steel as hydrogen trapping sites, hydrogen diffusion from the steel surface can be suppressed, and the delayed fracture resistance of a base steel sheet and a projection weld can be significantly improved. Some carbides formed during heating and hot rolling still exist as coarse carbides after final annealing. We found that, since coarse carbides make little contribution to the delay fracture resistance, a predetermined amount of fine carbide that can serve as hydrogen trapping sites is necessary to further improve the delay fracture resistance. In addition, we found that, in order to obtain a predetermined amount of fine carbide, it is necessary to properly control an annealing process to temper martensite and to form a predetermined amount of bainite. According to our founding, the carbides that serve as hydrogen trapping sites exist mainly in tempered martensite grains and bainite grains where the content of C is higher than that of ferrite, and the amount of precipitated carbide is small in ferrite grains where the content of C is low. Therefore, we found that it is important to control the volume fraction of the total of tempered martensite grains and bainite grains having a predetermined amount of carbide in the grains with respect to the total of tempered martensite grains and bainite grains in the steel sheet in order to secure carbides that serve as hydrogen trapping sites and to improve the delayed fracture resistance.

The present disclosure is based on the above findings. We thus provide the following.

[1] A high-strength thin steel sheet comprising a chemical composition containing (consisting of), in mass %, C: 0.10% or more and 0.22% or less, Si: 0.5% or more and 1.5% or less, Mn: 1.2% or more and 2.5% or less, P: 0.05% or less, S: 0.005% or less, Al: 0.01% or more and 0.10% or less, and N: 0.010% or less, with the balance being Fe and inevitable impurities, and a complex structure containing 5% or more and 35% or less of ferrite by volume fraction, 50% or more and 85% or less of tempered martensite by volume fraction, and 0% or more and 20% or less of bainite by volume fraction, wherein the ferrite has an average grain size of 5 μm or less, the tempered martensite has an average grain size of 5 μm or less, a volume fraction of a total of tempered martensite and bainite containing five or more carbides with a particle size of 0.1 μm or more and 1.0 μm or less in a grain with respect to a total of the tempered martensite and the bainite is 85% or more, and C mass % and Mn mass % in a region of 20 μm or less in a thickness direction from a surface of the steel sheet are each 20% or less with respect to C mass % and Mn mass % in a region of 100 μm or more and 200 μm or less from the surface of the steel sheet.

[2] The high-strength thin steel sheet according to [1], wherein the chemical composition further contains, in mass %, at least one selected from the group consisting of Ti: 0.05% or less, V: 0.05% or less, and Nb: 0.05% or less.

[3] The high-strength thin steel sheet according to [1] or [2], wherein the chemical composition further contains, in mass %, at least one selected from the group consisting of Mo: 0.50% or less, Cr: 0.50% or less, Cu: 0.50% or less, Ni: 0.50% or less, B: 0.0030% or less, Ca: 0.0050% or less, REM: 0.0050% or less, Ta: 0.100% or less, W: 0.500% or less, Sn: 0.200% or less, Sb: 0.200% or less, Mg: 0.0050% or less, Zr: 0.1000% or less, Co: 0.020% or less, and Zn: 0.020% or less.

[4] A method for manufacturing a high-strength thin steel sheet, comprising subjecting a steel slab having the chemical composition according to any one of [1] to [3] to hot rolling under condition of a finisher delivery temperature of 850° C. or higher and 950° C. or lower to obtain a hot-rolled sheet, next, cooling the hot-rolled sheet at a first average cooling rate of 30° C./s or higher to a coiling temperature of 550° C. or lower and then coiling the hot-rolled sheet at the coiling temperature, next, subjecting the hot-rolled sheet to pickling, next, subjecting the hot-rolled sheet after pickling to cold rolling with rolling reduction of 30% or more to obtain a cold-rolled sheet, next, heating the cold-rolled sheet at an average heating rate of 3° C./s or higher and 30° C./s or lower to a first soaking temperature of 800° C. or higher and 900° C. or lower with a dew point of −40° C. or higher and 10° C. or lower in a temperature range of 600° C. or higher, and holding the cold-rolled sheet at the first soaking temperature for 30 seconds or longer and 800 seconds or shorter, next, cooling the cold-rolled sheet from the first soaking temperature to a second soaking temperature of 350° C. or higher and 475° C. or lower at a second average cooling rate of 10° C./s or higher, and holding the cold-rolled sheet at the second soaking temperature for 300 seconds or shorter, next, cooling the cold-rolled sheet to room temperature at a third average cooling rate of 100° C./s or higher, next, reheating the cold-rolled sheet to a third soaking temperature of 200° C. or higher and 400° C. or lower, and holding the cold-rolled sheet at the third soaking temperature for 180 seconds or longer and 1800 seconds or shorter, and next, subjecting the cold-rolled sheet to pickling.

Advantageous Effect

According to the present disclosure, it is possible to provide a high-strength thin steel sheet having a tensile strength of 1180 MPa or more that has excellent workability, excellent delayed fracture resistance in a base steel sheet, and excellent delayed fracture resistance in a projection weld, and a method for manufacturing the same.

DETAILED DESCRIPTION

The following describes an embodiment of the present disclosure. Note that the present disclosure is not limited to the following embodiment. First, a proper range of the chemical composition of a base steel sheet and reasons for its limitation will be explained. The "%" representations below indicating the chemical composition of the steel sheet are in "mass %" unless otherwise specified.

C: 0.10% or More and 0.22% or Less

C is an element that is effective in increasing the strength of a steel sheet and that contributes to the formation of martensite and bainite, which is second phase. In the following description, the term "second phase" means "martensite and bainite" unless otherwise specified. When the C content is less than 0.10%, it is difficult to secure tensile strength because the volume fraction of ferrite increases. When the C content is less than 0.10%, the hole expansion formability deteriorates. The C content is preferably 0.12% or more. On the other hand, when the C content exceeds 0.22%, the hardness of a welding interface of a projection weld is excessively increased, so that the delayed fracture resistance of the projection weld is deteriorated. Further, the delayed fracture resistance of a base steel sheet is deteriorated. In addition, when the C content exceeds 0.22%, the volume fraction of ferrite decreases. Further, the elongation and the hole expansion formability deteriorate. The C content is preferably 0.21% or less and more preferably 0.20% or less.

Si: 0.5% or More and 1.5% or Less

Si is an element that strengthens ferrite by solid solution to contribute to increasing the strength of a steel sheet. When the Si content is less than 0.5%, not only the required strength cannot be secured, but also the hardness difference between ferrite and martensite increases to deteriorate the hole expansion ratio. Further, when the Si content is less than 0.5%, the volume fraction of ferrite increases, and the delayed fracture resistance of a base steel sheet and a projection weld deteriorates. Therefore, the Si content is set to 0.5% or more. The Si content is preferably 0.6% or more. On the other hand, excessive addition of Si reduces the toughness of a welding interface of a projection weld and deteriorates the delayed fracture resistance of the projection weld. Excessive addition of Si increases the volume fraction of ferrite, increases the average grain size of ferrite, and decreases the volume fraction of tempered martensite. Further, excessive addition of Si decreases the percentage of fine carbides, tensile strength, hole expansion formability, and the delayed fracture resistance of a base steel sheet. Therefore, the Si content is set to 1.5% or less. The Si content is preferably 1.4% or less.

Mn: 1.2% or More and 2.5% or Less

Mn is an element that contributes to increasing the strength of a steel sheet by promoting solid solution strengthening and the formation of the second phase. Mn also has the effect of stabilizing austenite during annealing. To obtain these effects, Mn should be contained 1.2% or more. The Mn content is preferably 1.4% or more. On the other hand, when Mn is contained excessively, band-shaped micro segregation (Mn band) is formed, resulting in deterioration of elongation, hole expansion formability and delay fracture resistance. Therefore, the Mn content is set to 2.5% or less. The Mn content is preferably 2.4% or less.

P: 0.05% or Less

P contributes to increasing the strength of a steel sheet by solid solution strengthening. However, when P is excessively added, segregation to grain boundaries becomes significant, causing embrittlement of grain boundaries and deterioration of delay fracture resistance. Therefore, the P content is set to 0.05% or less. The P content is preferably 0.04% or less. The lower limit of the P content is not particularly specified. However, the P content is preferably 0.0005% or more, because the manufacturing cost increases when the P content is extremely low.

S: 0.005% or Less

When the content of S is high, a large amount of sulfide such as MnS is formed, and delayed fracture occurs from the vicinity of the sulfide, resulting in deterioration of delay fracture resistance. Therefore, the S content is set to 0.005% or less. The S content is preferably 0.0045% or less. The lower limit of the S content is not specified. However, the S content is preferably 0.0002% or more, because the manufacturing cost increases when the S content is extremely low.

Al: 0.01% or More and 0.10% or Less

Al is an element required for deoxidation. To obtain this effect, Al should be contained 0.01% or more. When the Al content exceeds 0.10%, the effect is saturated. Therefore, the Al content is set to 0.10% or less. The Al content is preferably 0.06% or less.

N: 0.010% or Less

N forms coarse nitrides and deteriorates hole expansion formability and delay fracture resistance. Therefore, the N content is set to 0.010% or less. The N content is preferably 0.008% or less. The lower limit of the N content is not particularly specified, but it is preferably 0.0005% or more due to restrictions on manufacturing technologies.

[Optional Component]

In addition to the above components, the high-strength thin steel sheet of the present disclosure may further contain, in mass %, at least one selected from the group consisting of Ti: 0.05% or less, V: 0.05% or less, and Nb: 0.05% or less.

Ti: 0.05% or Less

Ti is an element that further increases the strength of a steel sheet by forming fine carbides, nitrides or carbonitrides. Ti can be added as necessary because the grain growth of fine carbonitrides during annealing can be suitably controlled by the addition of Ti. To obtain these effects, the Ti content is preferably 0.001% or more, and more preferably 0.01% or more. On the other hand, when Ti is added, its content is preferably 0.05% or less to obtain better elongation. The Ti content is more preferably 0.04% or less.

V: 0.05% or Less

V further increases the strength of a steel sheet by forming fine carbonitrides. To obtain this effect, the V content is preferably 0.001% or more and more preferably 0.01% or more. On the other hand, when V is added, its content is preferably 0.05% or less so that the toughness of a welding interface of a projection weld is further improved to further improve the delayed fracture resistance of the projection weld. The V content is more preferably 0.03% or less.

Nb: 0.05% or Less

Nb, like V, further increases the strength of a steel sheet by forming fine carbonitrides. To obtain this effect, the Nb content is preferably 0.001% or more and more preferably 0.01% or more. On the other hand, when Nb is added, its content is preferably 0.50% or less so that the toughness of a welding interface of a projection weld is further improved to further improve the delayed fracture resistance of the projection weld. The Nb content is more preferably 0.05% or less.

In addition to the above chemical composition, the high-strength thin steel sheet of the present disclosure may further contain, in mass %, at least one selected from the group consisting of Mo: 0.50% or less, Cr: 0.50% or less, Cu: 0.50% or less, Ni: 0.50% or less, B: 0.0030% or less, Ca: 0.0050% or less, REM: 0.0050% or less, Ta: 0.100% or less, W: 0.500% or less, Sn: 0.200% or less, Sb: 0.200% or less, Mg: 0.0050% or less, Zr: 0.1000% or less, Co: 0.020% or less, and Zn: 0.020% or less.

Mo: 0.50% or Less

Mo promotes the formation of second phase to further increase the strength of the steel sheet. It is also an element that stabilizes austenite during annealing and an element that is necessary for controlling the volume fraction of the second phase. To obtain these effects, the Mo content is preferably 0.010% or more and more preferably 0.05% or more. On the other hand, when Mo is added, its content is preferably 0.50% or less to prevent excessive formation of second phase to further improve the elongation and the hole expansion formability. The Mo content is more preferably 0.3% or less.

Cr: 0.50% or Less

Cr promotes the formation of second phase to further increase the strength of the steel sheet. To obtain such an effect, the Cr content is preferably 0.010% or more and more preferably 0.1% or more. On the other hand, when Cr is added, its content is preferably 0.50% or less so that excessive formation of second phase is prevented to further improve the elongation and the bending workability and excessive formation of surface oxides is prevented to further improve the chemical convertibility. The Cr content is more preferably 0.3% or less.

Cu: 0.50% or Less

Cu is an element that further increases the strength of the steel sheet by solid solution strengthening and by formation of second phase, and it can be added as necessary. To obtain such an effect, the Cu content is preferably 0.05% or more and more preferably 0.1% or more. On the other hand, when the Cu content exceeds 0.50%, the effect is saturated. Therefore, when Cu is added, its content is preferably 0.50% or less. The Cu content is more preferably 0.3% or less.

Ni: 0.50% or Less

Ni, like Cu, is an element that further increases the strength of the steel sheet by solid solution strengthening and by promoting the formation of second phase, and it can be added as necessary. To obtain such an effect, the Ni content is preferably 0.05% or more and more preferably 0.1% or more. Further, it is preferable to add Ni together with Cu because it has the effect of suppressing the surface defects caused by Cu. On the other hand, when Ni is added, its content is preferably 0.50% or less so that the toughness of a welding interface of a projection weld is improved to further improve the delayed fracture resistance of the projection weld. The Ni content is more preferably 0.3% or less.

B: 0.0030% or Less

B promotes the formation of second phase to further increase the strength of the steel sheet. It is also an element that can ensure hardenability without lowering the martensitic transformation start point. Further, it segregates at grain boundaries to improve the grain boundary strength, which is effective in further improving the delayed fracture resistance. To obtain these effects, the B content is preferably 0.0002% or more and more preferably 0.0005% or more. On the other hand, when B is added, its content is preferably 0.0030% or less so that the toughness is improved to further improve the delayed fracture resistance. The B content is more preferably 0.0025% or less.

Ca: 0.0050% or Less

Ca is an element that reduces the adverse effect on hole expansion formability through spheroidization of sulfides, and it can be added as necessary. To obtain such an effect, the Ca content is preferably 0.0005% or more. On the other hand, when the Ca content exceeds 0.0050%, the effect is saturated. Therefore, when Ca is added, its content is preferably 0.0050% or less. The Ca content is more preferably 0.003% or less.

REM: 0.0050% or Less

REM, like Ca, is an element that reduces the adverse effect on hole expansion formability through spheroidization of sulfides, and it can be added as necessary. To obtain such an effect, the REM content is preferably 0.0005% or more. On the other hand, when the REM content exceeds 0.0050%, the effect is saturated. Therefore, when REM is added, its content is preferably 0.0050% or less. The REM content is more preferably 0.0015% or less.

Ta: 0.100% or Less

Ta further increases the strength of the steel sheet by forming fine carbonitrides. To obtain such an effect, the Ta content is preferably 0.001% or more and more preferably 0.010% or more. On the other hand, when Ta is added, its content is preferably 0.100% or less so that the toughness of a welding interface of a projection weld is further improved to further improve the delayed fracture resistance of the projection weld. The Ta content is more preferably 0.050% or less.

W: 0.500% or Less

W further increases the strength of the steel sheet by forming fine carbonitrides. To obtain such an effect, the W content is preferably 0.001% or more and more preferably 0.010% or more. On the other hand, when W is added, its content is preferably 0.500% or less so that the toughness of a welding interface of a projection weld is further improved to further improve the delayed fracture resistance of the projection weld. The W content is more preferably 0.300% or less.

Sn: 0.200% or Less

Sn is an element that suppresses oxidation on the surface of the steel sheet during annealing, controls the thickness of a softened surface layer more suitably, and reduces the adverse effect on hole expansion formability, and it can be added as necessary. To obtain these effects, the Sn content is preferably 0.001% or more and more preferably 0.005% or more. On the other hand, when Sn is added, its content is preferably 0.200% or less so that the toughness of a welding interface of a projection weld is further improved to further improve the delayed fracture resistance of the projection weld. The Sn content is more preferably 0.050% or less.

Sb: 0.200% or Less

Sb is an element that suppresses oxidation on the surface of the steel sheet during annealing, controls the thickness of a softened surface layer more suitably, and reduces the adverse effect on hole expansion formability, and it can be added as necessary. To obtain these effects, the Sb content is preferably 0.001% or more and more preferably 0.005% or more. On the other hand, when Sb is added, its content is preferably 0.200% or less so that the toughness of a welding interface of a projection weld is further improved to further improve the delayed fracture resistance of the projection weld. The Sb content is more preferably 0.050% or less.

Mg: 0.0050% or Less

Mg is an element that reduces the adverse effect on hole expansion formability through spheroidization of sulfides, and it can be added as necessary. To obtain such an effect, the Mg content is preferably 0.0005% or more. On the other hand, when the Mg content exceeds 0.0050%, the effect is saturated. Therefore, when Mg is added, its content is preferably 0.0050% or less. The Mg content is more preferably 0.0030% or less.

Zr: 0.1000% or Less

Zr is an element that reduces the adverse effect on hole expansion formability through spheroidization of inclusions, and it can be added as necessary. To obtain such an effect, the Zr content is preferably 0.001% or more. On the other hand, when the Zr content exceeds 0.1000%, the effect is saturated. Therefore, when Zr is added, its content is preferably 0.1000% or less. The Zr content is more preferably 0.0030% or less.

Co: 0.020% or Less

Co is an element that reduces the adverse effect on hole expansion formability through spheroidization of inclusions, and it can be added as necessary. To obtain such an effect, the Co content is preferably 0.001% or more. On the other hand, when the Co content exceeds 0.020%, the effect is saturated. Therefore, when Co is added, its content is preferably 0.020% or less. The Co content is more preferably 0.010% or less.

Zn: 0.020% or Less

Zn is an element that reduces the adverse effect on hole expansion formability through spheroidization of inclusions, and it can be added as necessary. To obtain such an effect, the Zn content is preferably 0.001% or more. On the other hand, when the Zn content exceeds 0.020%, the effect is saturated. Therefore, when Zn is added, its content is preferably 0.020% or less. The Zn content is more preferably 0.010% or less.

The balance other than the aforementioned components is Fe and inevitable impurities.

The following provides a description of the microstructure of the high-strength thin steel sheet of the present disclosure. The microstructure of the high-strength thin steel sheet of the present disclosure is a complex structure containing 5% or more and 35% or less by volume fraction of ferrite, 50% or more and 85% or less by volume fraction of tempered martensite, and 20% or less by volume fraction of bainite. The average grain size of ferrite is 5 μm or less, and the average grain size of tempered martensite is 5 μm or less. The volume fraction as discussed herein refers to a volume fraction as related to the total steel sheet structure, and this definition is applicable throughout the following description. Further, the average grain size as discussed herein refers to a circular-equivalent crystal grain size.

Volume Fraction of Ferrite: 5% or More and 35% or Less

It is difficult to achieve a tensile strength of 1180 MPa or more in a microstructure where the volume fraction of ferrite exceeds 35%. The volume fraction of ferrite is preferably 30% or less. On the other hand, when the volume fraction of ferrite is less than 5%, the elongation is deteriorated due to excessive formation of the second phase. Therefore, the volume fraction of ferrite is set to 5% or more. The volume fraction of ferrite is preferably 10% or more and more preferably 15% or more. The volume fraction of ferrite is preferably 30% or less and more preferably 28% or less.

Average Grain Size of Ferrite: 5 μm or Less

When the average grain size of ferrite exceeds 5 μm, the toughness of a welding interface deteriorates due to further coarsening of crystal grains during projection welding, resulting in deterioration of delayed fracture resistance. Therefore, the crystal grain size of ferrite is set to 5 μm or less. The average grain size of ferrite is preferably 4 μm or less.

Volume Fraction of Tempered Martensite: 50% or More and 85% or Less

To ensure a tensile strength of 1180 MPa or more, the volume fraction of tempered martensite is set to 50% or more. On the other hand, when the volume fraction of tempered martensite exceeds 85%, the number of locations where cracks are formed during delayed fracture increases, resulting in deterioration of the delayed fracture resistance of a base steel sheet and a projection weld. Therefore, the upper limit of the volume fraction of tempered martensite is set to 85% or less. The volume fraction of tempered martensite is preferably 75% or less. The volume fraction of tempered martensite is preferably 60% or less.

Average Grain Size of Tempered Martensite: 5 μm or Less

When the average grain size of tempered martensite exceeds 5 μm, crystal grains are further coarsened during projection welding, resulting in deterioration of the toughness of a projection weld and deterioration of the delayed fracture resistance of a projection weld. Further, voids formed at the interface between martensite and ferrite tend to connect with each other, resulting in deterioration of hole expansion formability. Therefore, the upper limit is set to 5 μm. The average grain size of tempered martensite is preferably 4.5 μm or less and more preferably 4 μm or less.

Bainite: 0% or More and 20% or Less by Volume Fraction

Bainite may be contain by 20% or less by volume fraction to further increase the strength of the steel sheet. However, because bainite has a high dislocation density, voids are excessively formed after punching in a hole expanding test if the volume fraction exceeds 20%, resulting in deterioration of hole expansion formability. Therefore, the volume fraction of bainite is set to 20% or less. The volume fraction of bainite may be 0%. The volume fraction of bainite is preferably 15% or less.

The volume fractions of ferrite, tempered martensite and bainite are measured as follows. First, the steel sheet is cut so that a cross section along the thickness direction parallel to the rolling direction (L-section) becomes an observation position, the section is polished and then corroded with 3 vol. % nital to obtain an observation plane. Using a scanning electron microscope (SEM) and a field emission scanning electron microscope (FE-SEM), the observation plane is observed at a magnification of 3000 to obtain a micrograph. The area ratio of each phase is measured with the point counting method (in accordance with ASTM E562-83 (1988)), and the area ratio is taken as the volume fraction.

The average grain size of ferrite and tempered martensite is obtained by importing data in which ferrite grains and tempered martensite grains have been identified from the above-mentioned micrograph of SEM and FE-SEM into Image-Pro of Media Cybernetics, calculating the equivalent circular diameter of all ferrite grains and tempered martensite grains in the micrograph, and averaging the values.

In the microstructure of the high-strength thin steel sheet of the present disclosure, the volume fraction of the total of tempered martensite and bainite containing five or more carbides with a particle size of 0.1 μm or more and 1.0 μm or less in the grain with respect to the total of tempered martensite and bainite is 85% or more. With this microstructure, fine carbides with a particle size of 0.1 μm or more and 1.0 μm or less can function as trapping sites of hydrogen that penetrates into the steel, thereby improving the delayed fracture resistance of a base steel sheet and a projection weld. As described above, the volume fraction of bainite may be 0%, in which case the volume fraction of the total of tempered martensite containing five or more carbides with a particle size of 0.1 μm or more and 1.0 μm or less is 85% or more with respect to the total tempered martensite. Ferrite is not taken into account in the measurement of carbides, because carbides hardly precipitate in ferrite.

When the volume fraction of the total of tempered martensite and bainite containing five or more carbides with a particle size of 0.1 μm or more and 1.0 μm or less is less than 85% with respect to the total of tempered martensite and bainite, the amount of carbide that serve as trapping sites is insufficient, which deteriorates the delayed fracture resistance of a base steel sheet and a projection weld. Further, when the particle size of the carbides is less than 0.1 μm, the total surface area of the carbides that serve as trapping sites is small. As a result, the amount of trapped hydrogen is insufficient, and the delay fracture resistance is deteriorated. On the other hand, when the particle size of the carbides exceeds 1.0 μm, locations of stable trapping sites are limited. The hydrogen finally diffuses even if it is temporarily trapped, resulting in deterioration of delay fracture resistance. Further, when the number of carbides in the tempered martensite grains and bainite grains is less than five, the amount of carbide that serve as trapping sites is insufficient, which deteriorates the delayed fracture resistance. The volume fraction of the total of tempered martensite and bainite containing five or more carbides with a particle size of 0.1 μm or more and 1.0 μm or less with respect to the total of tempered martensite and bainite is preferably 88% or more and more preferably 90% or more.

The volume fraction of tempered martensite grains and bainite grains containing carbides with a particle size of 0.1 μm or more and 1.0 μm or less with respect to the total of all tempered martensite and bainite is measured as follows. First, the microstructure of the steel sheet is observed using a transmission electron microscope (TEM) at 20000 times at a position ¼ of the thickness from the surface of the steel sheet, and the particle size and number of carbides existing in all tempered martensite grains and bainite grains in the field of view are calculated. The particle size of the carbide is obtained by importing data in which the carbides have been identified into Image-Pro of Media Cybernetics and calculating the circular equivalent diameter. The total volume of tempered martensite grains and bainite grains containing five or more carbides with a particle size of 0.1 μm or more and 1.0 μm or less in the grain is calculated. The total volume of all tempered martensite and bainite is also calculated. The total volume of tempered martensite grains and bainite grains containing five or more carbides with a particle size of 0.1 μm or more and 1.0 μm or less in the grain is divided by the total volume of all tempered martensite and bainite to calculate the volume fraction of tempered martensite grains and bainite grains containing carbides with a particle size of 0.1 μm or more and 1.0 μm or less with respect to the total of all tempered martensite and bainite.

Further, in the high-strength thin steel sheet of the present disclosure, the C mass % and the Mn mass % in a region of 20 μm or less in the thickness direction from the surface of the steel sheet are each 20% or less with respect to the C mass % and the Mn mass % in a region of 100 μm or more and 200 μm or less from the surface of the steel sheet. By reducing the C mass % and the Mn mass % in a region of 20 μm or less in the thickness direction from the surface of the steel sheet, i.e., in a surface layer of the steel sheet, the initial current efficiency during projection welding can be increased to suppress the formation of microvoids. When the C mass % and the Mn mass % in a region of 20 μm or less in the thickness direction from the surface of the steel sheet exceeds 20% of the C mass % and the Mn mass % in a region of 100 μm or more and 200 μm or less from the surface of the steel sheet, microvoids exist in a welding interface during projection welding, which deteriorates the delayed fracture resistance of a projection weld. The C mass % in a region of 20 μm or less in the thickness direction from the surface of the steel sheet is preferably 15% or less and more preferably is 10% or less of the C mass % in a region of 100 μm or more and 200 μm or less from the surface of the steel sheet. In addition, the Mn mass % in a region of 20 μm or less in the thickness direction from the surface of the steel sheet is preferably 15% or less and more preferably 10% or less of the Mn mass % in a region of 100 μm or more and 200 μm or less from the surface of the steel sheet. The lower limit of the ratio of the C mass % in a region of 20 μm or less in the thickness direction from the surface of the steel sheet with respect to the C mass % in a region of 100 μm or more and 200 μm or less from the surface of the steel sheet is not specified, but it is preferably 1% or more. The lower limit of the ratio of the Mn mass % in a region of 20 μm or less in the thickness direction from the surface of the steel sheet with respect to the Mn mass % in a region of 100 μm or more and 200 μm or less from the surface of the steel sheet is not specified, but it is preferably 1% or more.

The ratio of the C mass % and the Mn mass % in a region of 20 μm or less in the thickness direction from the surface of the steel sheet with respect to the C mass % and the Mn mass % in a region of 100 μm or more and 200 μm or less from the surface of the steel sheet is measured as follows. First, a sample is cut out so that a cross section along the thickness direction parallel to the rolling direction of the steel sheet (L-section) becomes an observation plane, and the observation plane is polished with diamond paste. Next, the observation plane is subjected to finish polishing using alumina. Using an electron probe micro analyzer (EPMA), a line analysis is performed at three locations in a region of 200 μm or less in the thickness direction from the surface of the steel sheet on the observation plane, the ratio of the C mass % and the Mn mass % in a region of 20 μm or less in the thickness direction from the surface of the steel sheet with respect to the C mass % and the Mn mass % in a region of 100 μm or more and 200 μm or less from the surface of the steel sheet is calculated at each location, and the average of the three locations is determined.

In addition to ferrite, tempered martensite and bainite, the microstructure of the high-strength thin steel sheet of the present disclosure may contain retained austenite, pearlite and non-recrystallized ferrite. However, the volume fraction of retained austenite is preferably 10% or less and more preferably 5% or less. The volume fraction of pearlite is preferably 10% or less and more preferably 5% or less. The volume fraction of non-recrystallized ferrite is preferably 10% or less and more preferably 5% or less.

The volume fraction of retained austenite is measured as follows. First, the steel sheet is polished in the thickness direction (depth direction) up to ¼ of the sheet thickness to obtain an observation plane. The observation plane is observed with X-ray diffraction method. The integrated intensity of the X-ray diffracted rays of the [200], [211], and [220] planes of ferrite and the [200], [220], and [311] planes of austenite of iron are measured using an X-ray diffractometer (RINT2200 manufactured by Rigaku) at accelerating voltage of 50 keV with MoKα source as a radiation source. Using these measured values, the volume fraction of retained austenite is determined with the formula described in "Handbook of X-ray Diffraction" (2000) Rigaku Corporation, p. 26, 62-64.

The methods for measuring the volume fractions of pearlite and non-recrystallized ferrite are as follows. First, the steel sheet is cut so that a cross section along the thickness direction parallel to the rolling direction (L-section) becomes an observation position, the section is polished and then corroded with 3 vol. % nital to obtain an observation plane. Using a scanning electron microscope (SEM) and a field emission scanning electron microscope (FE-SEM), the observation plane is observed at a magnification of 3000 to obtain a micrograph. The area ratio of each phase is measured with the point counting method (in accordance with ASTM E562-83 (1988)), and the area ratio is taken as the volume fraction.

The high-strength thin steel sheet of the present disclosure may also include a coating or plating layer. The composition of the coating or plating layer is not specified and may be a common composition. The coating or plating layer may be formed with any method, and it may be a hot-dip coating layer or an electroplated layer, for example. The coating or plating layer may be alloyed. The type of metal for coating or plating is not specified, and it may be Zn coating or plating, Al coating or plating, or the like.

Next, a method for manufacturing the high-strength thin steel sheet of the present disclosure will be described. For the method for manufacturing the high-strength thin steel sheet, each temperature range refers to the surface temperature of a steel slab or steel sheet, unless otherwise specified.

In the method for manufacturing the high-strength thin steel sheet of the present disclosure, a steel slab having the chemical composition described above is subjected to hot rolling under condition of a finisher delivery temperature of 850° C. or higher and 950° C. or lower to obtain a hot-rolled sheet, next, the hot-rolled sheet is cooled at a first average cooling rate of 30° C./s or higher to a coiling temperature of 550° C. or lower and is then coiled at the coiling temperature, next, the hot-rolled sheet is subjected to pickling, next, the hot-rolled sheet after pickling is subjected to cold rolling with rolling reduction of 30% or more to obtain a cold-rolled sheet, next, the cold-rolled sheet is heated at an average heating rate of 3° C./s or higher and 30° C./s or lower to a first soaking temperature of 800° C. or higher and 900° C. or lower with a dew point of −40° C. or higher and 10° C. or lower in a temperature range of 600° C. or higher, and the cold-rolled sheet is held at the first soaking temperature for 30 seconds or longer and 800 seconds or shorter, next, the cold-rolled sheet is cooled from the first soaking temperature to a second soaking temperature of 350° C. or higher and 475° C. or lower at a second average cooling rate of 10° C./s or higher, and the cold-rolled sheet is held at the second soaking temperature for 300 seconds or shorter, next, the cold-rolled sheet is cooled to room temperature at a third average cooling rate of 100° C./s or higher, next, the cold-rolled sheet is reheated to a third soaking temperature of 200° C. or higher and 400° C. or lower and held at the third soaking temperature for 180 seconds or longer and 1800 seconds or shorter, and next, the cold-rolled sheet is subjected to pickling.

First, a steel slab having the chemical composition described above is produced. First, steel materials are melted to obtain molten steel having the chemical composition described above. The melting method is not specified, and any known melting method such as melting by a converter or melting by an electric furnace may be suitably used. The obtained molten steel is solidified to produce a steel slab (slab). The method for producing a steel slab with molten steel is not specified, and continuous casting, ingot casting, thin slab casting or the like may be used. The steel slab is preferably produced by continuous casting to prevent macro segregation.

Next, the produced steel slab is subjected to hot rolling under the condition of a finisher delivery temperature of 850° C. or higher and 950° C. or lower to obtain a hot-rolled sheet. For example, the steel slab thus produced may be once cooled to room temperature and then subjected to slab heating and then to rolling. The slab heating temperature is preferably 1100° C. or higher from the viewpoint of dissolution of carbides and reduction of rolling load. The slab heating temperature is preferably 1300° C. or lower to prevent an increase in scale loss.

Alternatively, the hot rolling may be performed with what is called "energy-saving" processes. Examples of the "energy-saving" processes include direct rolling in which the produced steel slab without being fully cooled to room temperature is charged into a heating furnace as a warm slab to be hot rolled, and direct rolling in which the produced steel slab undergoes heat retaining for a short period and immediately subjected to rolling.

Finisher Delivery Temperature of Hot Rolling: 850° C. or Higher and 950° C. or Lower The finish rolling of hot rolling needs to be finished in an austenite single-phase region in order to improve the delayed fracture resistance of a base steel sheet and a projection weld after annealing by improving the uniform refinement of the microstructure in the steel sheet and reducing the anisotropy of materials. Therefore, the finisher delivery temperature of hot rolling is set to 850° C. or higher. On the other hand, when the finisher delivery temperature exceeds 950° C., the microstructure of the hot-rolled sheet is coarsened, and the crystal grains after annealing are also coarsened, resulting in deterioration of the hole expansion formability and the delayed fracture resistance of a base steel sheet and a projection weld. Therefore, the finisher delivery temperature of hot rolling is set to 850° C. or higher and 950° C. or lower. The finisher delivery temperature of hot rolling is preferably 880° C. or higher. The finisher delivery temperature of hot rolling is preferably 920° C. or lower.

First Average Cooling Rate: 30° C./s or Higher

Next, the hot-rolled sheet is cooled to a coiling temperature of 550° C. or lower at a first average cooling rate of 30° C./s or higher. After hot rolling, austenite undergoes ferrite transformation during cooling. However, ferrite coarsens if the cooling rate is too slow, so that rapid cooling is performed after hot rolling to homogenize the microstructure. Therefore, the hot-rolled sheet after hot rolling is cooled to 550° C. or lower at a first average cooling rate of 30° C./s or higher. The hot-rolled sheet after hot rolling is preferably cooled to 550° C. or lower at a first average cooling rate of 35° C./s or higher. When the first average cooling rate is lower than 30° C./s, ferrite is coarsened. As a result, the microstructure of the hot-rolled sheet becomes inhomogeneous, and the hole expansion formability and the delayed fracture resistance of a base steel sheet and a projection weld deteriorate. Although the upper limit of the first average cooling rate is not specified, it is preferably 250° C./s and more preferably 100° C./s or lower due to restrictions on manufacturing technologies.

Coiling Temperature: 550° C. or Lower

Next, the hot-rolled sheet that has been cooled to a coiling temperature of 550° C. or higher is coiled at a coiling temperature of 550° C. or lower. When the coiling temperature exceeds 550° C., ferrite and pearlite are excessively formed in the microstructure of the hot-rolled sheet, a uniform fine microstructure cannot be obtained, and the average grain size of ferrite and tempered martensite in the microstructure of a final high-strength thin steel sheet is coarsened, resulting in an inhomogeneous microstructure and deterioration of the hole expansion formability, the delayed fracture resistance of a base steel sheet, and the delayed fracture resistance of a projection weld. The coiling temperature is preferably 500° C. or lower. The lower limit of the coiling temperature is not specified. However, when the coiling temperature is too low, hard martensite is excessively formed, which increases cold rolling load. Therefore, the coiling temperature is preferably 300° C. or higher.

Next, the hot-rolled sheet is subjected to pickling after coiling and before cold rolling to remove scales on the surface of the hot-rolled sheet. The pickling conditions may be set as appropriate.

Next, the hot-rolled sheet after pickling is subjected to cold rolling with rolling reduction of 30% or more to obtain a cold-rolled sheet. In the present disclosure, cold rolling is performed with rolling reduction of 30% or more. This is because, when the rolling reduction is less than 30%, recrystallization of ferrite is not promoted, and ferrite and martensite are coarsened, resulting in deterioration of hole expansion formability, delayed fracture resistance and elongation. Although the upper limit of the rolling reduction is not specified, it is preferably 95% or less due to restrictions on manufacturing technologies.

Next, the cold-rolled sheet is subjected to annealing to promote recrystallization and to form fine ferrite, martensite and bainite in the microstructure of the steel sheet to increase the strength. Specifically, the cold-rolled sheet is heated at an average heating rate of 3° C./s or higher and 30° C./s or lower to a first soaking temperature of 800° C. or higher and 900° C. or lower with a dew point of −40° C. or higher and 10° C. or lower in a temperature range of 600° C. or higher, held at the first soaking temperature for 30 seconds or longer and 800 seconds or shorter, then cooled at a second average cooling rate of 10° C./s or higher from the first soaking temperature to a second soaking temperature of 350° C. or higher and 475° C. or lower, held at the second soaking temperature for 300 seconds or shorter, then cooled to room temperature at a third average cooling rate of 100° C./s or higher, then reheated to a third soaking temperature of 200° C. or higher and 400° C. or lower, and held at the third soaking temperature for 180 seconds or longer and 1800 seconds or shorter.

First, the cold-rolled sheet is heated at an average heating rate of 3° C./s or higher and 30° C./s or lower to a first soaking temperature of 800° C. or higher and 900° C. or lower with a dew point of −40° C. or higher and 10° C. or lower in a temperature range of 600° C. or higher and held at the first soaking temperature for 30 seconds or longer and 800 seconds or shorter. In the following description, the holding at the first soaking temperature of 800° C. or higher and 900° C. or lower for 30 seconds or longer and 800 seconds or shorter is also referred to as "first soaking".

Average Heating Rate: 3° C./s or Higher and 30° C./s or Lower

By heating the cold-rolled sheet to a first soaking temperature of 800° C. or higher and 900° C. or lower at an average heating rate of 3° C./s or higher and 30° C./s or lower, it is possible to refine the crystal grains obtained after annealing. Rapid heating of the cold-rolled sheet renders recrystallization difficult and leads to anisotropic crystal grains. Further, the volume fraction of ferrite increases while the volume fraction of tempered martensite decreases. As a result, it is difficult to achieve a tensile strength of 1180 MPa or more, and the elongation, the hole expansion formability, and the delayed fracture resistance of a base steel sheet and a projection weld are deteriorated. Therefore, the average heating rate is set to 30° C./s or lower. When the heating rate is too low, ferrite and martensite grains are coarsened, the predetermined average grain size cannot be achieved, and the hole expansion formability and the delayed fracture resistance of a base steel sheet and a projection weld are deteriorated. Therefore, the average heating rate is set to 3° C./s or higher. The average heating rate of the cold-rolled sheet to the first soaking temperature of 800° C. or higher and 900° C. or lower is preferably 5° C./s or higher.

Dew Point in a Temperature Range of 600° C. or Higher: −40° C. or Higher and 10° C. or Lower To reduce the C mass % and the Mn mass % in a surface layer of the steel sheet after annealing, the dew point in a temperature range of 600° C. or higher is set to −40° C. or higher and 10° C. or lower during the heating up to the first soaking temperature and the first soaking. In an annealing furnace, when the dew point in a range where the surface temperature of the steel sheet is 600° C. or higher is −40° C. or higher and 10° C. or lower, it is taken as that the dew point in a temperature range of 600° C. or higher is −40° C. or higher and 10° C. or lower. When the dew point is lower than −40° C., the C mass % and the Mn mass % in the surface layer increase, and the delayed fracture resistance of a projection weld deteriorates. The dew point in a temperature range of 600° C. or higher is preferably −30° C. or higher. By setting the dew point to −30° C. or higher, the C mass % in a region of 20 μm or less in the thickness direction from the surface of the steel sheet is less than 10% of the C mass % in a region of 100 μm or more and 200 μm or less from the surface of the steel sheet, which further improve the delayed fracture resistance. On the other hand, when the dew point exceeds 10° C., the Mn mass % in the surface layer of the steel sheet after annealing increases, and the delayed fracture resistance of a projection weld deteriorates. The dew point in a temperature range 600° C. or higher is preferably 5° C. or lower.

First Soaking Temperature: 800° C. or Higher and 900° C. or Lower

The first soaking temperature is a predetermined temperature set in a temperature range of a ferrite and austenite dual phase region. When the first soaking temperature is lower than 800° C., the fraction of ferrite increases, and the volume fraction of tempered martensite decreases, rendering it difficult to ensure the strength. Therefore, the first soaking temperature is set to 800° C. or higher. On the other hand, when the soaking temperature is too high, the soaking occurs in an austenite single phase region, and the crystal grains of austenite grow largely, resulting in coarsening of the crystal grains. As a result, the average crystal grain size of finally obtained tempered martensite increases, the volume fraction of tempered martensite increases, and the elongation, the hole expansion formability, and the delayed fracture resistance of a base steel sheet and a projection weld deteriorate.

Therefore, the first soaking temperature is set to 900° C. or lower. The first soaking temperature is preferably 880° C. or lower.

Holding Time at First Soaking Temperature: 30 Seconds or Longer and 800 Seconds or Shorter The steel sheet is held at the first soaking temperature for 30 seconds or longer to allow recrystallization to occur and to allow a part of the microstructure to undergo austenite transformation. When the holding time at the first soaking temperature is shorter than 30 seconds, the volume fraction of ferrite increases, and the volume fraction of tempered martensite decreases, resulting in deterioration of tensile strength. On the other hand, when the holding time at the first soaking temperature is longer than 800 seconds, the micro segregation of Mn is promoted, which deteriorates the hole expansion formability and the delayed fracture resistance of a base steel sheet and a projection weld. Therefore, the holding time at the first soaking temperature is set to 800 seconds or shorter. The holding time is preferably 600 seconds or shorter. By setting the holding time to 600 seconds or shorter, the Mn mass % in a region of 20 μm or less in the thickness direction from the surface of the steel sheet is less than 10% of the Mn mass % in a region of 100 μm or more and 200 μm or less from the surface of the steel sheet, thereby improving the delayed fracture resistance.

Next, the cold-rolled sheet is cooled from the first soaking temperature to a second soaking temperature of 350° C. or higher and 475° C. or lower at a second average cooling rate of 10° C./s or higher, held at the second soaking temperature for 300 seconds or shorter, and then cooled to room temperature at a third average cooling rate of 100° C./s or higher. In the following description, the holding at the second soaking temperature for 300 seconds or shorter is also referred to as "second soaking".

Second Average Cooling Rate: 10° C./s or Higher

After the first soaking, the steel sheet is cooled from the first soaking temperature to room temperature at a second average cooling rate of 10° C./s or higher. When the average cooling rate is lower than 10° C./s, ferrite transformation progresses during cooling, which increases the volume fraction of ferrite and deteriorates the tensile strength and the hole expansion formability. Although the upper limit of the second average cooling rate is not specified, it is preferably 200° C./s or lower, more preferably 100° C./s or lower, and still more preferably 50° C./s or lower due to restrictions on manufacturing technologies.

Second Soaking Temperature: 350° C. or Higher and 475° C. or Lower

When the cooling stop temperature after soaking is lower than 350° C., some austenite grains undergo martensite transformation, and the subsequent tempering treatment further coarsens carbides. As a result, carbides serving as hydrogen trapping sites are insufficient, and the delay fracture resistance deteriorates. When the cooling stop temperature after soaking exceeds 475° C., pearlite excessively forms. As a result, the volume fraction of tempered martensite decreases, the volume fraction of ferrite increases, and the tensile strength and the hole expansion formability deteriorate. The second soaking temperature is preferably 450° C. or lower.

Holding Time at Second Soaking Temperature: 300 Seconds or Shorter

After the cooling described above, the steel sheet is held at the predetermined second soaking temperature of 350° C. or higher and 475° C. or lower for 300 seconds or shorter to form bainite. When the holding time exceeds 300 seconds, the volume fraction of bainite increases, and the hole expansion formability deteriorates. In addition, the number of carbides with a particle size of 0.1 μm or more and 1.0 μm or less contained in tempered martensite grains and bainite grains decreases, and the delayed fracture resistance of a base steel sheet and a projection weld deteriorates. Therefore, the holding time at the second soaking temperature is set to 300 seconds or shorter. The holding time at the second soaking temperature is preferably 200 seconds or shorter. The lower limit of the holding time at the second soaking temperature is not specified, and it may be 0 seconds.

Third Average Cooling Rate: 100° C./s or Higher

This is an extremely important feature of the present disclosure. After the second soaking, the cold-rolled sheet is cooled at a third average cooling rate of 100° C./s or higher to transform remaining austenite to martensite. When the third average cooling rate is lower than 100° C./s, carbides are coarsened by the subsequent tempering treatment. As a result, the amount of fine carbide that serves as a hydrogen trapping site is insufficient, and the delayed fracture resistance of a base steel sheet and a projection weld is deteriorated. The third average cooling rate is preferably 150° C./s or higher and more preferably 200° C./s or higher. The cooling method may be any method that can obtain a third average cooling rate of 100° C./s or higher, and examples thereof includes gas cooling, mist cooling, and water cooling. Water cooling is preferably from the viewpoint of low cost. Although the upper limit of the third average cooling rate is not specified, it is preferably 2000° C./s or lower and more preferably 1200° C./s or lower due to restrictions on manufacturing technologies.

Next, the cold-rolled sheet that has been cooled to room temperature is reheated to a third soaking temperature of 200° C. or higher and 400° C. or lower and held at the third soaking temperature for 180 seconds or longer and 1800 seconds or shorter. The tempering treatment improves the delayed fracture resistance by tempering martensite.

Third Soaking Temperature: 200° C. or Higher and 400° C. or Lower

When the third soaking temperature is lower than 200° C. or higher than 400° C., fine carbides with a particle size of 0.1 μm or more and 1.0 μm or less cannot be sufficiently obtained. As a result, carbides that serve as hydrogen trapping sites are insufficient, and the delayed fracture resistance of a base steel sheet and a projection weld is deteriorated.

Holding Time at Third Soaking Temperature: 180 Seconds or Longer and 1800 Seconds or Shorter When the third soaking temperature is shorter than 180 seconds or longer than 1800 seconds, fine carbides with a particle size of 0.1 μm or more and 1.0 μm or less cannot be sufficiently obtained, either. As a result, carbides that serve as hydrogen trapping sites are insufficient, and the delayed fracture resistance of a base steel sheet and a projection weld is deteriorated. The holding time at the third soaking temperature is preferably 1500 seconds or shorter.

Pickling Treatment

Next, the cold-rolled sheet after tempering treatment is subjected to pickling treatment. Pickling is performed to remove oxides of Si, Mn and the like concentrated in the surface layer of the steel sheet. Without pickling, these oxides cannot be sufficiently removed, and alloying elements such as Si and Mn are excessively concentrated on the surface of the steel sheet, resulting in deterioration of the delayed fracture resistance of a projection weld. The conditions of pickling are not specified, and any of common pickling methods using hydrochloric acid, sulfuric acid, or the like can be applied. However, it is preferable to perform pickling under conditions of a pH of 1.0 or more and 4.0 or less, a temperature of 10° C. or higher and 100° C. or lower, and an immersion time of 5 seconds or longer and 200 seconds or shorter.

After pickling, the high-strength thin steel sheet may be subjected to coating or plating treatment. The type of metal for coating or plating is not specified, and it is zinc in one example. Examples of galvanizing treatment include hot-dip galvanizing treatment, and galvannealing treatment where alloying treatment is performed after hot-dip galvanizing treatment. When hot-dip galvanizing is applied, the temperature of the high-strength thin steel sheet immersed in the molten bath is preferably (hot-dip galvanizing bath temperature−40° C.) or higher and (hot-dip galvanizing bath temperature+50° C.) or lower. In the case where the temperature of the high-strength thin steel sheet immersed in the molten bath is (hot-dip galvanizing bath temperature−40° C.) or higher, the solidification of the molten zinc can be prevented more suitably when the steel sheet is immersed in the molten bath, and the coating appearance can be improved. In the case where the temperature of the high-strength thin steel sheet immersed in the molten bath is (hot-dip galvanizing bath temperature+50° C.) or lower, the mass productivity is further improved.

After hot-dip galvanizing, alloying treatment may be performed on the zinc coating in a temperature range of 450° C. or higher and 600° C. or lower. By applying alloying treatment in a temperature range of 450° C. or higher and 600° C. or lower, the Fe concentration in the zinc coating is made to 7% or more and 15% or less, which improves the adhesion of hot-dip galvanizing and the corrosion resistance after coating.

The hot-dip galvanizing preferably uses a galvanizing bath containing 0.10% or more and 0.20% or less of Al. After the galvanizing process, the steel sheet may be subjected to wiping so as to adjust the coating weight.

The high-strength thin steel sheet after pickling may be subjected to temper rolling. When the high-strength thin steel sheet after pickling is subjected to temper rolling, the elongation rate of the temper rolling is preferably 0.05% or more and 2.0% or less.

Examples

The following describes examples of the present disclosure. The present disclosure is by no means limited by the examples described below, and can be implemented with appropriate modifications without departing from the spirit of the present disclosure. All such modifications are encompassed by the technical scope of the present disclosure.

Steel materials having the chemical compositions listed in Table 1 were prepared by steelmaking and subjected to continuous casting to produce steel slabs. Next, the steel slabs were subjected to hot rolling with the hot rolling heating temperature being 1250° C. and the finisher delivery temperature (FDT) being as listed in Table 2 to obtain hot-rolled sheets. Next, the hot-rolled sheets were cooled to the coiling temperature (CT) at the first average cooling rate (cooling rate 1) listed in Table 2 and coiled at the coiling temperature. Next, the hot-rolled sheets after pickling were subjected to cold rolling at the rolling reduction listed in Table 2 to produce cold-rolled sheets (thickness: 1.4 mm). The cold-rolled sheets thus obtained were supplied to a continuous annealing line (CAL) and subjected to the following annealing. First, the cold-rolled sheets were heated at the average heating rate listed in Table 2 and annealed at the first soaking temperature for the soaking time (first holding time) listed in Table 2. Next, the cold-rolled sheets were cooled to the second soaking temperature at the second average cooling rate (cooling rate 2) listed in Table 2. Next, the cold-rolled sheets were held at the second soaking temperature for the time listed in Table 2 (second holding time), and then cooled to room temperature at the third average cooling rate (cooling rate 3). Next, as tempering treatment, the cold-rolled sheets were reheated to the third soaking temperature, held at the third soaking temperature for the time listed in Table 2 (the third holding time), and then subjected to pickling to obtain steel sheets.

A JIS No. 5 tensile test piece was collected from each of the produced steel sheets so that the direction orthogonal to the rolling direction was the longitudinal direction (tensile direction), and the tensile strength (TS) and the elongation (EL) were measured by a tensile test in accordance with JIS Z2241 (1998).

The hole expansion ratio was measured in accordance with JIS Z2256 (2010). Holes of 10 mmφ were punched at a clearance of 12.5%, and a testing machine was set so that the turnaround would be on the die side. Next, the holes were pushed open with a 60-degree conical punch, and the amount of expansion of the hole diameter when a crack at the edge of the hole penetrated in the thickness direction on at least one location was expressed as a ratio of the hole diameter when the crack penetrated with respect to the initial hole diameter, which was defined as the hole expansion ratio (λ). A steel sheet having λ (%) of 50% or more was considered to be a steel sheet having good hole expansion formability.

The delayed fracture resistance of a base steel sheet was measured as follows. First, a 30 mm×100 mm steel piece was cut out from each of the produced steel sheets with the rolling direction being the longitudinal direction. The end face of the steel piece was ground. Further, two bolt holes were provided at opposite positions when the steel piece was U-bent in the longitudinal direction to obtain a test piece. The test piece was subjected to 180-degree U-bending with a curvature radius of 10 mm at punch end using a press forming machine. After the U-bending process, the test piece was deformed due to springback (elastic recovery) so that the opposing surfaces were separated from each other (so that the U-bend opened outward). A bolt was inserted into the bolt holes of the test piece with springback, the bolt was fastened so that the distance between the opposing surfaces was 20 mm or 25 mm, and a stress was applied to the test piece. The test piece with a bolt fastened was immersed in a 3.0% NaCl+0.3% $NH_4SCN$ solution at 25° C., and an electrolytic charge was conducted with the test piece being the cathode to allow hydrogen to penetrate into the steel of the test piece. The current density was set at 1.0 mA/cm$^2$, and the counter electrode was platinum. A test piece that had a distance of 25 mm between opposing surfaces and did not fracture even after 100 hours of immersion was evaluated as having good delayed fracture resistance of a base steel sheet (good), and a test piece that had a distance of 20 mm between opposing surfaces and did not fracture even after 100 hours of immersion is evaluated as having particularly good delayed fracture resistance of a base steel sheet (excellent).

The delayed fracture resistance of a projection weld was measured as follows. First, a 50 mm×150 mm test piece was collected from each of the produced steel sheets, and a hole with a diameter of 10 mm was made in the center. The test piece and an M6 welding nut having four projection portions were set in an AC welding machine so that the center of the hole of the test piece and the center of the hole of the nut coincided with each other. The test piece and the welding nut were subjected to projection welding using a servomotor pressure type AC (50 Hz) welding gun attached to the AC welding machine to obtain a test piece with a projection weld. A pair of electrode tips used in the welding gun was flat 30 mmφ electrodes. The welding conditions were an electrode force of 3000 N, a welding time of 7 cycles (50 Hz), a welding current of 12 kA, and a holding time of 10 cycles (50 Hz). A bolt was fixed in the nut hole of the test piece with the projection weld, and the test piece was placed on top of a spacer. Next, a push-in peeling test was performed in accordance with JIS B 1196 (2001), where the bolt was screwed into the welded nut, a compressive load was gradually applied to the head of the bolt so that the center of the load coincided with the center of the screw as much as possible, and the load when the nut peeled off from the steel sheet was measured. The peeling strength at this time was defined as PS. Test pieces with a fixed bolt were prepared in the same way as above and loaded with 0.5×PS and 0.7×PS. Next, the test pieces were immersed in a hydrochloric acid solution (pH=2.2) at room temperature, and the time until the nut peeled off from the steel sheet was evaluated. In the case of a load of 0.5×PS, a test piece that did not fracture after 100 hours was evaluated to have good delayed fracture resistance of a projection weld (good), and in the case of a load of 0.7×PS, a test piece that did not fracture after 100 hours was evaluated to have particularly good delayed fracture resistance of a projection weld (excellent).

The volume fractions of ferrite, tempered martensite and bainite and the average grain sizes of ferrite and tempered martensite in the produced steel sheets were calculated according to the methods described above. The volume fractions of retained austenite, pearlite, and non-recrystallized ferrite were calculated according to the methods described above.

The volume fractions of tempered martensite grains and bainite grains containing carbides with a particle size of 0.1 μm or more and 1.0 μm or less with respect to the total of all tempered martensite and bainite was calculated according to the method described above. Further, the ratio of the C mass % and the Mn mass % in a region of 20 μm or less in the thickness direction from the surface of the steel sheet with respect to the C mass % and the Mn mass % in a region of 100 μm or more and 200 μm or less from the surface of the steel sheet was measured according to the method described above.

The results of measurements of the steel sheet microstructure, tensile strength, elongation, hole expansion formability, and delayed fracture resistance of a base steel sheet and a projection weld are listed in Table 3.

TABLE 1

| Steel sample | Chemical composition (mass %) | | | | | | | | |
|---|---|---|---|---|---|---|---|---|---|
| ID | C | Si | Mn | P | S | Al | N | Other component | Remarks |
| A | 0.14 | 1.11 | 2.21 | 0.01 | 0.001 | 0.03 | 0.002 | — | Conforming steel |
| B | 0.16 | 1.45 | 1.29 | 0.01 | 0.001 | 0.02 | 0.003 | Ti: 0.03, Nb: 0.02, B: 0.0015 | Conforming steel |
| C | 0.12 | 0.54 | 2.43 | 0.01 | 0.002 | 0.03 | 0.002 | V: 0.02, Mo: 0.12, Ca: 0.0011 | Conforming steel |
| D | 0.21 | 0.84 | 1.85 | 0.01 | 0.001 | 0.03 | 0.003 | Cu: 0.15, Ni: 0.19 | Conforming steel |
| E | 0.15 | 0.95 | 1.54 | 0.01 | 0.001 | 0.02 | 0.002 | Cr: 0.22, REM: 0.0008 | Conforming steel |
| F | 0.24 | 1.44 | 2.14 | 0.01 | 0.002 | 0.03 | 0.003 | — | Comparative example |
| G | 0.09 | 1.15 | 1.98 | 0.01 | 0.002 | 0.03 | 0.002 | Ti: 0.03 | Comparative example |
| H | 0.15 | 1.66 | 1.58 | 0.01 | 0.002 | 0.03 | 0.003 | Mo: 0.21 | Comparative example |
| I | 0.14 | 0.44 | 2.33 | 0.01 | 0.002 | 0.03 | 0.003 | Cu: 0.25 | Comparative example |
| J | 0.15 | 1.22 | 2.68 | 0.01 | 0.002 | 0.03 | 0.003 | V: 0.03 | Comparative example |
| K | 0.14 | 1.05 | 1.05 | 0.01 | 0.002 | 0.03 | 0.003 | — | Comparative example |
| L | 0.13 | 1.05 | 2.12 | 0.01 | 0.001 | 0.02 | 0.002 | Ta: 0.020, W: 0.020 | Conforming steel |
| M | 0.15 | 1.22 | 1.95 | 0.01 | 0.001 | 0.03 | 0.003 | Ti: 0.02, Sn: 0.025, Sb: 0.025 | Conforming steel |
| N | 0.14 | 1.16 | 2.22 | 0.01 | 0.002 | 0.02 | 0.002 | Mg: 0.0015, Zr: 0.0015 | Conforming steel |
| O | 0.17 | 1.38 | 2.39 | 0.01 | 0.002 | 0.03 | 0.003 | Nb: 0.02, Co: 0.005, Zn: 0.005 | Conforming steel |

The underline indicates outside the proper range of the present disclosure.

TABLE 2

| | | Hot rolling | | | Cold rolling | Annealing | | | | | | | | | | | |
|---|---|---|---|---|---|---|---|---|---|---|---|---|---|---|---|---|---|
| Sample No. | Steel sample ID | FDT (° C.) | Cooling rate 1 (° C./s) | CT (° C.) | Rolling reduction (%) | Average heating rate (° C./s) | Dew point (° C.) | First soaking temperature (° C.) | First holding time (second) | Cooling rate 2 (° C./s) | Second soaking temperature (° C.) | Second holding time (second) | Cooling rate 3 (° C./s) | Third soaking temperature (° C.) | Third holding time (second) | Pickling | Remarks |
| 1 | A | 900 | 50 | 500 | 50 | 10 | −10 | 840 | 300 | 15 | 400 | 20 | 850 | 305 | 250 | Yes | Example |
| 2 | B | 900 | 35 | 540 | 35 | 12 | −10 | 855 | 50 | 12 | 450 | 5 | 880 | 220 | 1200 | Yes | Example |
| 3 | C | 900 | 50 | 450 | 70 | 5 | −25 | 860 | 300 | 11 | 450 | 0 | 1020 | 310 | 800 | Yes | Example |
| 4 | D | 900 | 50 | 500 | 40 | 12 | 5 | 810 | 300 | 12 | 375 | 10 | 182 | 220 | 650 | Yes | Example |
| 5 | E | 900 | 40 | 500 | 60 | 12 | −12 | 835 | 300 | 12 | 450 | 150 | 800 | 380 | 200 | Yes | Example |
| 6 | B | 900 | 40 | 520 | 50 | 10 | −35 | 845 | 300 | 15 | 400 | 60 | 850 | 255 | 500 | Yes | Example |
| 7 | C | 900 | 40 | 500 | 50 | 10 | 8 | 840 | 700 | 15 | 350 | 20 | 500 | 320 | 300 | Yes | Example |
| 8 | D | 800 | 35 | 540 | 35 | 12 | −10 | 855 | 50 | 12 | 450 | 5 | 880 | 220 | 1200 | Yes | Comparative example |

TABLE 2-continued

| Sample No. | Steel sample ID | Hot rolling FDT (° C.) | Hot rolling Cooling rate 1 (° C./s) | Hot rolling CT (° C.) | Cold rolling Rolling reduction (%) | Annealing Average heating rate (° C./s) | Annealing Dew point (° C.) | Annealing First soaking temperature (° C.) | Annealing First holding time (second) | Annealing Cooling rate 2 (° C./s) | Annealing Second soaking temperature (° C.) | Annealing Second holding time (second) | Annealing Third cooling rate 3 (° C./s) | Annealing Third soaking temperature (° C.) | Annealing Third holding time (second) | Pickling | Remarks |
|---|---|---|---|---|---|---|---|---|---|---|---|---|---|---|---|---|---|
| 9 | E | 1100 | 35 | 540 | 35 | 12 | −10 | 855 | 50 | 12 | 450 | 5 | 880 | 220 | 1200 | Yes | Comparative example |
| 10 | A | 900 | 20 | 500 | 40 | 10 | −10 | 840 | 300 | 13 | 400 | 60 | 850 | 250 | 300 | Yes | Comparative example |
| 11 | A | 900 | 50 | 600 | 50 | 10 | −10 | 840 | 300 | 12 | 400 | 60 | 850 | 250 | 300 | Yes | Comparative example |
| 12 | B | 900 | 70 | 500 | 10 | 10 | −10 | 830 | 300 | 12 | 400 | 60 | 850 | 250 | 300 | Yes | Comparative example |
| 13 | B | 900 | 50 | 500 | 40 | −1 | −10 | 830 | 300 | 14 | 390 | 60 | 850 | 250 | 300 | Yes | Comparative example |
| 14 | A | 920 | 50 | 500 | 50 | 50 | −10 | 840 | 300 | 12 | 400 | 5 | 850 | 250 | 300 | Yes | Comparative example |
| 15 | C | 920 | 50 | 500 | 50 | 10 | −50 | 840 | 300 | 12 | 400 | 5 | 850 | 250 | 300 | Yes | Comparative example |
| 16 | B | 920 | 50 | 500 | 50 | 10 | 20 | 840 | 300 | 12 | 400 | 5 | 850 | 250 | 300 | Yes | Comparative example |
| 17 | B | 900 | 60 | 500 | 50 | 10 | −10 | 750 | 300 | 12 | 400 | 60 | 850 | 250 | 300 | Yes | Comparative example |
| 18 | B | 900 | 50 | 450 | 50 | 10 | −10 | 950 | 300 | 14 | 415 | 10 | 850 | 250 | 300 | Yes | Comparative example |
| 19 | B | 900 | 50 | 500 | 50 | 10 | −10 | 820 | 10 | 12 | 400 | 100 | 850 | 250 | 300 | Yes | Comparative example |
| 20 | A | 900 | 40 | 520 | 50 | 10 | −25 | 845 | 2000 | 15 | 400 | 60 | 850 | 255 | 500 | Yes | Comparative example |
| 21 | C | 880 | 55 | 550 | 60 | 10 | −10 | 850 | 300 | 5 | 400 | 100 | 850 | 250 | 300 | Yes | Comparative example |
| 22 | C | 900 | 50 | 500 | 70 | 5 | −10 | 800 | 300 | 12 | 550 | 200 | 850 | 250 | 300 | Yes | Comparative example |
| 23 | B | 900 | 50 | 500 | 50 | 10 | −10 | 820 | 600 | 12 | 250 | 100 | 850 | 250 | 300 | Yes | Comparative example |
| 24 | D | 900 | 100 | 450 | 50 | 10 | −10 | 840 | 300 | 14 | 400 | 600 | 850 | 250 | 300 | Yes | Comparative example |
| 25 | C | 900 | 50 | 500 | 50 | 10 | −10 | 820 | 300 | 12 | 400 | 60 | 20 | 250 | 300 | Yes | Comparative example |
| 26 | E | 900 | 50 | 500 | 60 | 10 | −10 | 850 | 300 | 20 | 420 | 10 | 850 | 100 | 300 | Yes | Comparative example |
| 27 | C | 900 | 50 | 480 | 50 | −8 | −10 | 820 | 600 | 12 | 400 | 60 | 850 | 500 | 300 | Yes | Comparative example |
| 28 | D | 900 | 50 | 500 | 50 | 10 | −10 | 820 | 300 | 12 | 400 | 0 | 850 | 250 | 20 | Yes | Comparative example |
| 29 | A | 900 | 35 | 450 | 50 | 10 | −10 | 820 | 300 | 15 | 380 | 60 | 850 | 250 | 2500 | Yes | Comparative example |
| 30 | C | 900 | 50 | 500 | 50 | 10 | −10 | 840 | 300 | 15 | 400 | 20 | 850 | 305 | 250 | No | Comparative example |

TABLE 2-continued

| Sample No. | Steel sample ID | Hot rolling FDT (° C.) | Hot rolling Cooling rate 1 (° C./s) | Hot rolling CT (° C.) | Cold rolling Rolling reduction (%) | Annealing Average heating rate (° C./s) | Annealing Dew point (° C.) | Annealing First soaking temperature (° C.) | Annealing First holding time (second) | Annealing Cooling rate 2 (° C./s) | Annealing Second soaking temperature (° C.) | Annealing Second holding time (second) | Annealing Third cooling rate 3 (° C./s) | Annealing Third soaking temperature (° C.) | Annealing Third holding time (second) | Pickling | Remarks |
|---|---|---|---|---|---|---|---|---|---|---|---|---|---|---|---|---|---|
| 31 | F | 900 | 50 | 500 | 70 | 10 | −10 | 860 | 600 | 12 | 400 | 100 | 850 | 250 | 300 | Yes | Comparative example |
| 32 | G | 900 | 50 | 550 | 50 | 15 | −10 | 820 | 300 | 14 | 400 | 20 | 850 | 250 | 300 | Yes | Comparative example |
| 33 | H | 900 | 50 | 500 | 50 | 10 | −10 | 820 | 300 | 12 | 410 | 60 | 850 | 250 | 300 | Yes | Comparative example |
| 34 | I | 900 | 40 | 500 | 50 | 10 | −10 | 840 | 600 | 13 | 400 | 20 | 850 | 250 | 300 | Yes | Comparative example |
| 35 | J | 900 | 50 | 500 | 50 | 10 | −10 | 820 | 300 | 12 | 400 | 60 | 850 | 250 | 300 | Yes | Comparative example |
| 36 | K | 900 | 50 | 450 | 50 | 12 | −10 | 840 | 300 | 11 | 400 | 100 | 850 | 250 | 300 | Yes | Comparative example |
| 37 | B | 900 | 50 | 500 | 60 | 15 | −45 | 880 | 50 | 15 | 400 | 50 | 800 | 300 | 400 | Yes | Comparative example |
| 38 | L | 880 | 35 | 450 | 70 | 10 | −15 | 820 | 100 | 12 | 375 | 10 | 600 | 250 | 500 | Yes | Example |
| 39 | M | 900 | 40 | 500 | 60 | 15 | −25 | 840 | 50 | 15 | 400 | 60 | 880 | 300 | 300 | Yes | Example |
| 40 | N | 920 | 45 | 540 | 50 | 12 | −10 | 860 | 200 | 11 | 450 | 20 | 800 | 275 | 600 | Yes | Example |
| 41 | O | 900 | 50 | 520 | 40 | 15 | −20 | 850 | 300 | 15 | 425 | 50 | 700 | 350 | 400 | Yes | Example |

The underline indicates outside the proper range of the present disclosure.

TABLE 3

| Sample No. | Steel sheet microstructure: Ferrite Volume fraction (%) | Ferrite Average grain size (μm) | Tempered martensite Volume fraction (%) | Tempered martensite Average grain size (μm) | Bainite Volume fraction (%) | The balance Type | The balance Volume fraction (%) | Percentage (%) of containing 5 or more carbides of 0.1 μm to 1.0 μm or less*1 | C % within 20 μm/C % within 100 μm to 200 μm*2 |
|---|---|---|---|---|---|---|---|---|---|
| 1 | 24 | 4 | 70 | 3 | 6 | — | 0 | 95 | 5 |
| 2 | 21 | 3 | 69 | 3 | 8 | RA | 2 | 95 | 7 |
| 3 | 16 | 2 | 75 | 4 | 9 | — | 0 | 90 | 8 |
| 4 | 28 | 4 | 65 | 4 | 7 | — | 0 | 90 | 2 |
| 5 | 18 | 4 | 73 | 4 | 8 | P | 1 | 88 | 5 |
| 6 | 15 | 3 | 72 | 4 | 13 | — | 0 | 85 | 12 |
| 7 | 23 | 4 | 70 | 4 | 7 | — | 0 | 85 | 7 |
| 8 | 21 | 8 | 70 | 5 | 6 | — | 0 | 88 | 6 |
| 9 | 20 | 7 | 75 | 6 | 5 | — | 0 | 88 | 11 |
| 10 | 16 | 6 | 76 | 4 | 8 | — | 0 | 88 | 4 |
| 11 | 18 | 6 | 78 | 6 | 4 | — | 0 | 90 | 5 |
| 12 | 22 | 7 | 70 | 7 | 3 | RF | 5 | 90 | 7 |
| 13 | 28 | 6 | 68 | 6 | 4 | — | 0 | 88 | 8 |
| 14 | 38 | 3 | 46 | 4 | 4 | RF | 12 | 88 | 8 |
| 15 | 24 | 4 | 70 | 4 | 6 | — | 0 | 88 | 92 |
| 16 | 22 | 5 | 72 | 5 | 6 | — | 0 | 88 | 12 |
| 17 | 51 | 5 | 38 | 4 | 11 | — | 0 | 88 | 10 |
| 18 | 0 | — | 92 | 7 | 8 | — | 0 | 90 | 7 |
| 19 | 59 | 5 | 31 | 5 | 2 | RF | 8 | 88 | 8 |
| 20 | 15 | 5 | 70 | 5 | 15 | — | 0 | 85 | 7 |
| 21 | 38 | 5 | 55 | 5 | 7 | — | 0 | 90 | 8 |
| 22 | 40 | 5 | 48 | 5 | 0 | P | 12 | 90 | 6 |
| 23 | 28 | 5 | 72 | 5 | 0 | — | 0 | 68 | 8 |
| 24 | 24 | 5 | 52 | 4 | 24 | — | 0 | 80 | 7 |

TABLE 3-continued

| | | | | | | | | | |
|---|---|---|---|---|---|---|---|---|---|
| 25 | 25 | 4 | 68 | 5 | 7 | — | 0 | 72 | 6 |
| 26 | 24 | 5 | 70 | 5 | 6 | — | 0 | 65 | 5 |
| 27 | 19 | 4 | 75 | 5 | 6 | — | 0 | 75 | 7 |
| 28 | 22 | 5 | 74 | 5 | 4 | — | 0 | 65 | 6 |
| 29 | 24 | 5 | 68 | 5 | 8 | — | 0 | 70 | 15 |
| 30 | 19 | 4 | 68 | 5 | 13 | — | 0 | 88 | 23 |
| 31 | 4 | 4 | 80 | 5 | 11 | RA | 5 | 90 | 8 |
| 32 | 45 | 5 | 52 | 5 | 3 | — | 0 | 90 | 7 |
| 33 | 38 | 6 | 48 | 5 | 8 | RA | 6 | 80 | 8 |
| 34 | 36 | 5 | 59 | 5 | 5 | — | 0 | 90 | 7 |
| 35 | 10 | 5 | 88 | 5 | 2 | — | 0 | 85 | 7 |
| 36 | 40 | 5 | 54 | 5 | 6 | — | 0 | 90 | 7 |
| 37 | 30 | 5 | 65 | 5 | 5 | — | 0 | 95 | 45 |
| 38 | 29 | 3 | 66 | 3 | 5 | — | 0 | 90 | 7 |
| 39 | 26 | 3 | 68 | 3 | 6 | — | 0 | 92 | 8 |
| 40 | 21 | 4 | 72 | 4 | 7 | — | 0 | 88 | 6 |
| 41 | 24 | 4 | 70 | 4 | 6 | — | 0 | 94 | 7 |

| Sample No. | Mn % within 20 μm/ Mn % within 100 μm to 200 μm*3 | Tensile properties TS (MPa) | Tensile properties EL (%) | Hole expansion ratio λ (%) | Delayed fracture resistance: Base steel sheet | Delayed fracture resistance: Projection weld | Remarks |
|---|---|---|---|---|---|---|---|
| 1 | 6 | 1221 | 16.2 | 65 | Excellent | Excellent | Example |
| 2 | 4 | 1255 | 14.9 | 55 | Excellent | Excellent | Example |
| 3 | 5 | 1311 | 14.2 | 68 | Excellent | Excellent | Example |
| 4 | 5 | 1219 | 15.3 | 54 | Excellent | Excellent | Example |
| 5 | 8 | 1245 | 14.3 | 55 | Excellent | Excellent | Example |
| 6 | 5 | 1195 | 14.1 | 50 | Good | Good | Example |
| 7 | 14 | 1188 | 14.5 | 52 | Good | Good | Example |
| 8 | 15 | 1189 | 14.3 | 51 | Poor | Poor | Comparative example |
| 9 | 11 | 1199 | 14.3 | 41 | Poor | Poor | Comparative example |
| 10 | 5 | 1255 | 14.9 | 43 | Poor | Poor | Comparative example |
| 11 | 8 | 1189 | 14.3 | 40 | Poor | Poor | Comparative example |
| 12 | 9 | 1211 | 11.5 | 28 | Poor | Poor | Comparative example |
| 13 | 8 | 1235 | 14.5 | 45 | Poor | Poor | Comparative example |
| 14 | 8 | 1111 | 8.8 | 22 | Poor | Poor | Comparative example |
| 15 | 25 | 1224 | 15.5 | 58 | Excellent | Poor | Comparative example |
| 16 | 45 | 1201 | 14.6 | 60 | Excellent | Poor | Comparative example |
| 17 | 5 | 988 | 18.3 | 52 | Excellent | Excellent | Comparative example |
| 18 | 7 | 1332 | 10.1 | 38 | Poor | Poor | Comparative example |
| 19 | 8 | 899 | 19.1 | 51 | Excellent | Excellent | Comparative example |
| 20 | 21 | 1211 | 14.3 | 41 | Poor | Poor | Comparative example |
| 21 | 7 | 1155 | 14.5 | 45 | Excellent | Excellent | Comparative example |
| 22 | 7 | 1125 | 14.8 | 42 | Excellent | Good | Comparative example |
| 23 | 9 | 1298 | 14.1 | 55 | Poor | Poor | Comparative example |
| 24 | 7 | 1188 | 14.9 | 43 | Poor | Poor | Comparative example |
| 25 | 8 | 1198 | 15.5 | 61 | Poor | Poor | Comparative example |
| 26 | 6 | 1229 | 15.1 | 54 | Poor | Poor | Comparative example |
| 27 | 7 | 1242 | 15.1 | 55 | Poor | Poor | Comparative example |
| 28 | 6 | 1218 | 14.2 | 56 | Poor | Poor | Comparative example |
| 29 | 7 | 1205 | 14.9 | 55 | Poor | Poor | Comparative example |
| 30 | 22 | 1211 | 14.8 | 55 | Excellent | Poor | Comparative example |
| 31 | 8 | 1355 | 11.8 | 43 | Poor | Poor | Comparative example |
| 32 | 8 | 1005 | 21.1 | 43 | Good | Excellent | Comparative example |
| 33 | 8 | 1121 | 14.3 | 48 | Poor | Poor | Comparative example |
| 34 | 7 | 1164 | 15.1 | 45 | Poor | Poor | Comparative example |
| 35 | 11 | 1342 | 11.3 | 38 | Poor | Poor | Comparative example |
| 36 | 7 | 1153 | 14.3 | 50 | Good | Good | Comparative example |
| 37 | 18 | 1215 | 14.6 | 55 | Good | Poor | Comparative example |
| 38 | 4 | 1220 | 15.5 | 58 | Excellent | Excellent | Example |
| 39 | 6 | 1250 | 15.1 | 54 | Excellent | Excellent | Example |
| 40 | 5 | 1235 | 15.3 | 52 | Excellent | Excellent | Example |
| 41 | 8 | 1270 | 14.9 | 55 | Excellent | Excellent | Example |

The underline indicates outside the proper range of the present disclosure.

The balance: RA—retained austenite, P—pearlite, RF—non-recrystallized ferrite

*1 Ratio of a total of tempered martensite and bainite containing five or more carbides of 0.1 μm or more and 1.0 μm or less in a grain to a total of tempered martensite and bainite (volume fraction)

*2 Ratio of C mass % in a region of 20 μm or less in a thickness direction from the steel sheet surface to C mass % in a region of 100 μm or more and 200 μm or less from the steel sheet surface

*3 Ratio of Mn mass % in a region of 20 μm or less in a thickness direction from the steel sheet surface to Mn mass % in a region of 100 μm or more and 200 μm or less from the steel sheet surface The Examples were superior in all of the tensile strength, elongation, hole expansion formability, delayed fracture resistance of a base steel sheet, and delayed fracture resistance of a projection weld. On the other hand, the Comparative Examples were inferior in at least one of the tensile strength, elongation, hole expansion formability, delayed fracture resistance of a base steel sheet, and delayed fracture resistance of a projection weld.

The invention claimed is:

1. A high-strength thin steel sheet comprising a chemical composition containing, in mass %, C: 0.10% or more and 0.22% or less,
Si: 0.5% or more and 1.5% or less,
Mn: 1.2% or more and 2.5% or less,
P: 0.05% or less,
S: 0.005% or less,
Al: 0.01% or more and 0.10% or less, and
N: 0.010% or less,
with the balance being Fe and inevitable impurities, and a complex structure containing 5% or more and 30% or less of ferrite by volume fraction,
50% or more and 85% or less of tempered martensite by volume fraction, and
0% or more and 20% or less of bainite by volume fraction, wherein the ferrite has an average grain size of 5 μm or less, the tempered martensite has an average grain size of 5 μm or less, a volume fraction of a total of tempered martensite and bainite containing five or more carbides with a particle size of 0.1 μm or more and 1.0 μm or less in a grain with respect to a total of the tempered martensite and the bainite is 85% or more, and C mass % and Mn mass % in a region of 20 μm or less in a thickness direction from a surface of the steel sheet are each 20% or less with respect to C mass % and Mn mass % in a region of 100 μm or more and 200 μm or less from the surface of the steel sheet.

2. The high-strength thin steel sheet according to claim 1, wherein the chemical composition further contains, in mass %, at least one selected from the group consisting of Ti: 0.05% or less,
V: 0.05% or less, and
Nb: 0.05% or less.

3. The high-strength thin steel sheet according to claim 1, wherein the chemical composition further contains, in mass %, at least one selected from the group consisting of Mo: 0.50% or less,
Cr: 0.50% or less,
Cu: 0.50% or less,
Ni: 0.50% or less,
B: 0.0030% or less,
Ca: 0.0050% or less,
REM: 0.0050% or less,
Ta: 0.100% or less,
W: 0.500% or less,
Sn: 0.200% or less,
Sb: 0.200% or less,
Mg: 0.0050% or less,
Zr: 0.1000% or less,
Co: 0.020% or less, and
Zn: 0.020% or less.

4. The high-strength thin steel sheet according to claim 2, wherein the chemical composition further contains, in mass %, at least one selected from the group consisting of Mo: 0.50% or less,
Cr: 0.50% or less,
Cu: 0.50% or less,
Ni: 0.50% or less,
B: 0.0030% or less,
Ca: 0.0050% or less,
REM: 0.0050% or less,
Ta: 0.100% or less,
W: 0.500% or less,
Sn: 0.200% or less,
Sb: 0.200% or less,
Mg: 0.0050% or less,
Zr: 0.1000% or less,
Co: 0.020% or less, and
Zn: 0.020% or less.

* * * * *